United States Patent [19]

Strömberg et al.

[11] Patent Number: 4,920,843

[45] Date of Patent: May 1, 1990

[54] DEVICE FOR RETAINING KNIFE BLADE FOR CUTTING A PAPER WEB

[76] Inventors: Sven A. R. Strömberg, Norbybillsbro, Ringåker, Sweden; Rolf A. Larsson, Södra Promenaden 7, Påsboda, Sweden

[21] Appl. No.: 400,392

[22] Filed: Aug. 30, 1989

[30] Foreign Application Priority Data

Feb. 6, 1989 [SE] Sweden ..... 8900391

[51] Int. Cl.[5] ..... B26D 1/62

[52] U.S. Cl. ..... 83/346; 83/663; 83/698; 83/699

[58] Field of Search ..... 83/343, 344, 345, 346, 83/347, 348, 698, 699, 660, 663, 674

[56] References Cited

U.S. PATENT DOCUMENTS

| | | | |
|---|---|---|---|
| 2,682,306 | 6/1954 | Schriber | 83/346 |
| 3,251,256 | 5/1966 | McGrath | 83/674 |
| 3,769,868 | 11/1973 | Hornung | 83/674 |
| 3,865,164 | 2/1975 | Sybertz | 83/698 |
| 4,392,402 | 7/1983 | Rann | 83/674 |
| 4,848,202 | 7/1989 | Crampton | 83/343 |

*Primary Examiner*—Frank T. Yost

*Assistant Examiner*—Scott A. Smith

*Attorney, Agent, or Firm*—Bacon & Thomas

[57] ABSTRACT

The present invention relates to a device for retaining knife blades for cutting, perforation or other treatment of a running web, preferably a paper web, whereby the web (4) runs between a rotatable knife retaining cylinder (3) and a rotatable counter pressure cylinder (5) and whereby the knife blade (2) and a retaining ruler (7) for retaining the blade (2) are provided in a slot (6) in the knife retaining cylinder (3). In order to reduce the time for mounting the knife blades, the retaining ruler (7) has a relative to the slot (6) downwardly inclined wedge surface (10), through which the ruler (7) cooperates with a corresponding downwardly inclined wedge surface (11) on a tightening ruler (9) disposed beside the retaining ruler in the slot (6), and the knife blade (2) is provided, during an adjustment manoeuvre at which the knife retaining cylinder (3) is rotated relative to the counter pressure cylinder (5), to be pressed downwards into the slot (6) by the counter pressure cylinder (5), whereby the blade (2) through a support portion (12) on the retaining ruler (7) displaces the ruler (7) downwards relative to the tightening ruler (9) for wedging up the rulers (7, 9) and the blade (2) in the slot (6).

10 Claims, 4 Drawing Sheets

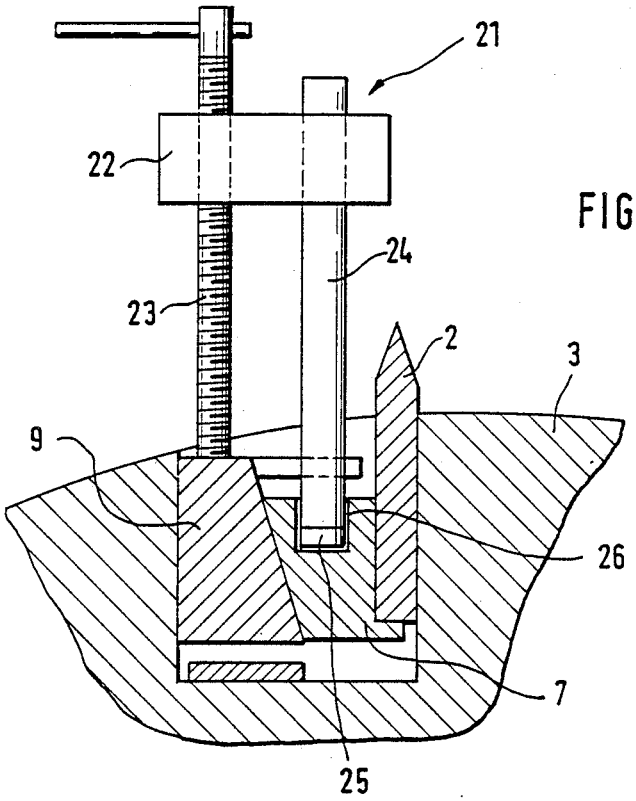
FIG. 5
FIG. 6
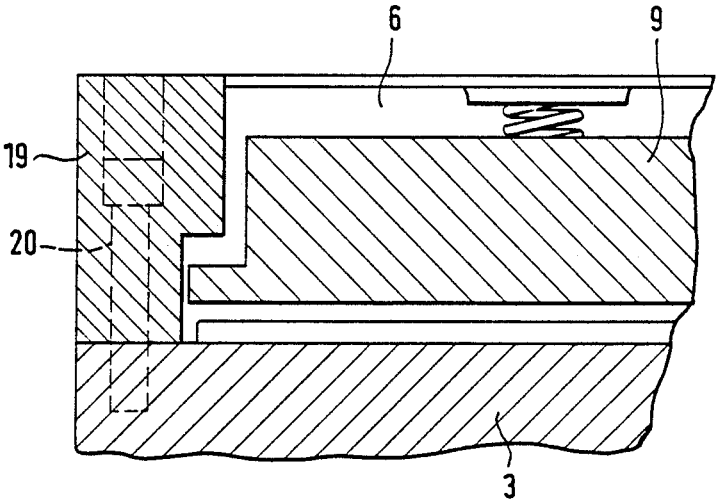

DEVICE FOR RETAINING KNIFE BLADE FOR CUTTING A PAPER WEB

The present invention relates to a device for retaining knife blades for cutting, perforation or other treatment of a running web, preferably a paper web, whereby said web runs between a rotatable knife-retaining cylinder and a counter pressure cylinder, whereby the knife blade and a retaining ruler for holding the knife blade are provided in a slot in the knife retaining cylinder.

At prior art devices of the above type it takes much too long time to brace a knife blade. Since the cylinder in question often has six knife blades, there is a longer breakdown when the knife blades must be exchanged or adjusted. This because each retaining ruler, so called setting ruler, has a setting screw on every tenth centimeter and each such screw must be tightened twice. The mounting of the knife blade is namely carried out so that the setting screws are tightened with a dynamometric wrench, whereafter a so called setting turn is made by rotating the cylinder with the knife blade or blades one turn relative to the counter pressure cylinder. When the knife blade strikes the counter pressure cylinder, said cylinder press the knife blade down into the slot to its correct position. Thereafter, the setting screw is permanently tightened with a box wrench and the device is ready for operation.

The object of the present invention is to provide a device of the above type with the improvement that it enables a substantially quicker mounting of knife blades than previously. This is arrived at by providing the device with the characterizing features of claim 1.

The device defined in claim 1 is remarkably time-saving when mounting a knife blade. The screwing moments required previously are eliminated and replaced by a wedge-up function which is automatically carried out when the knife blade is pressed down into the slot during the setting turn.

The invention will be further described below with reference to the accompanying drawings, wherein FIG. 1 is a perspective view of two devices according to the invention mounted on a cylinder;

FIG. 5 is a cross-sectional view of the device according to the invention at a point where a withdrawal device is connected to the device according to the invention; and FIG. 6 is a longitudinal section of an end portion of the device according to the invention.

Figure 1:
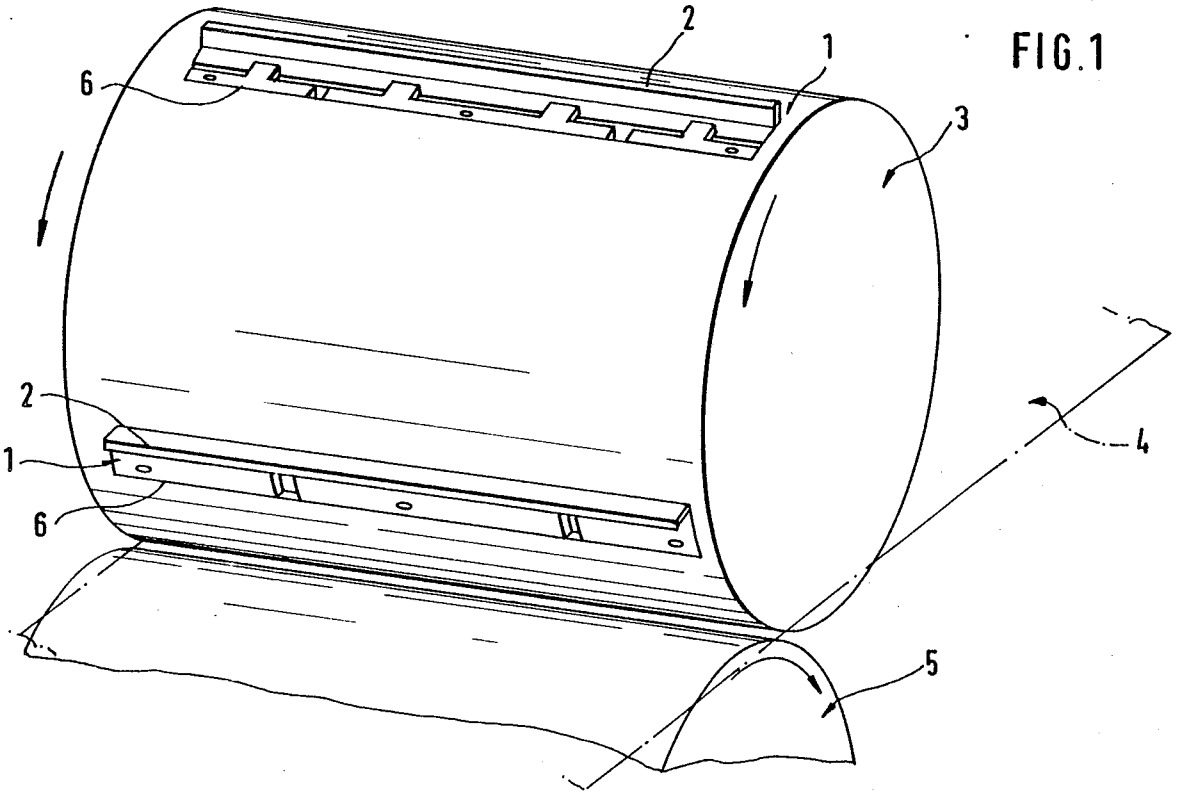

The retaining device 1 shown in the drawings is adapted for retaining a knife blade 2 on a rotatable knife retaining cylinder 3. The knife blade 2 is adapted for cutting, perforation or other treatment of a running web 4, preferably a paper web, which e.g. runs through a printing press (not shown). The web 4 runs through a space between the knife retaining cylinder 3 and a rotatable counter pressure cylinder 5 and is shown with dashed and dotted lines in FIG. 1.

The knife retaining cylinder 3 has a number of slots 6, normally six, for receiving knife blades therein. The illustrated device enables mounting of the knife blade 2 with a wedge-up moment. For this purpose the retaining device has a retaining ruler 7 which is adapted to retain the knife blade against one side wall 8 of the slot 6. The retaining device 1 also comprises a tightening ruler 9 disposed beside the retaining ruler 7 and adapted to engage the opposite side wall 10 of the slot 6. The retaining ruler 7 has a wedge surface 11 facing the tightening ruler 9 and extenidng in a direction sloping downwards relative to the slot 6. In other words, the wedge surface extends such that it, seen from above and downwards, approaches the side wall 8 of the slot 6.

The wedge surface 11 of the retaining ruler 7 cooperates with a corresponding wedge surface 11 on the tightening ruler 9. The wedge surface 11 also extends in a downwardly inclined direction relative to the slot 6 and also approaches the side wall 8 of said slot seen from above and downwards.

Figure 2:
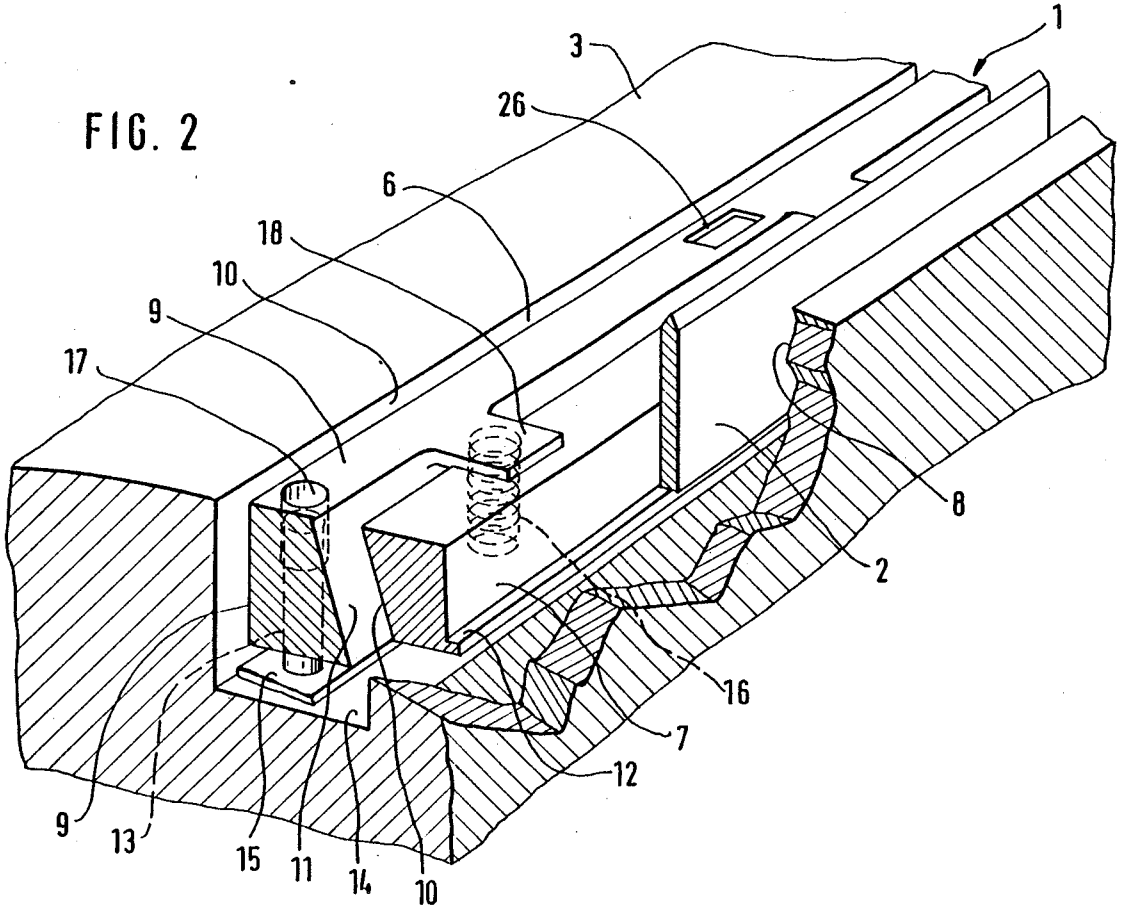
FIG. 2 is a sectional view along the line II—II in FIG. 1.
Figure 3:
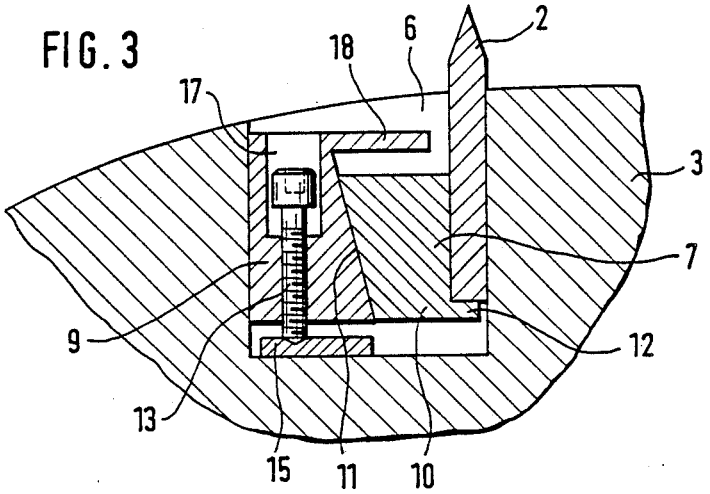
FIG. 3 is a cross-sectional view of the device according to the invention at a point where the device is provided with height adjustment means.
Figure 4:
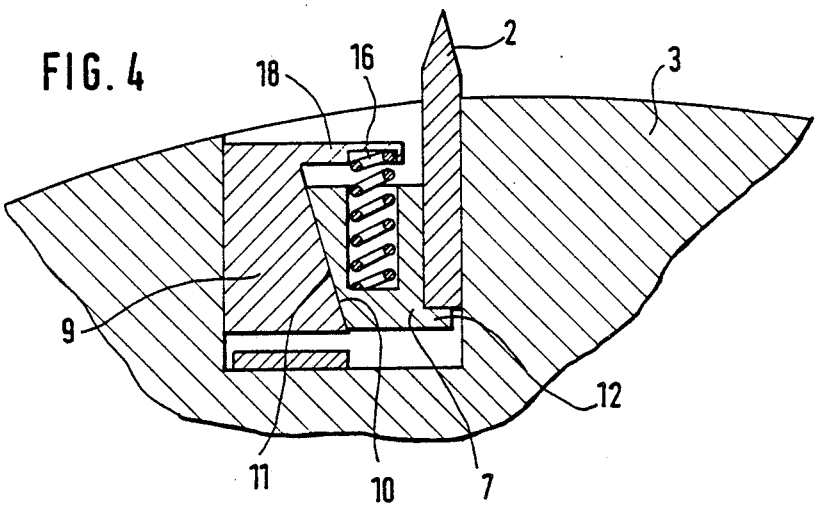
FIG. 4 is a cross-sectional view of the device according to the invention at a point where the device is provided with resilient means.

The retaining ruler 7 includes a support portion 12 through which the blade 2 displaces the retaining ruler 7 during an adjustment manoeuvre. This support portion 12 may be provided on different portions of the retaining ruler 7 and may have various designs A suitable position for the support portion 12 is down below on the retaining ruler 7 as shown in e.g. FIG. 2. The support portion 12 may further preferably be a flange protruding laterally from the retaining ruler 7, extending along the entire length thereof and having a width less than the thickness of the knife blade 2.

The tightening ruler 9 preferably has a plurality of height adjustment means 13 adapted to determine at which height the tightening ruler 9 shall be set from the bottom 14 of the slot 6. These height adjustment means 13 can be set to alter a certain height position of the tightening ruler 9 relative to the bottom 14 of the slot 6 to another height position. The height adjustment means 13 may be of a suitable type and be disposed in a suitable manner. An example of a preferred height adjustment means 13 is a screw which is screwed into the tightening ruler 9 and protrudes downwards as a leg through which the tightening ruler 9 engages the bottom 14 of the slot 6 or suitably a protective strip 15 on the bottom 14 of the slot 6 and of a harder material than the material in the knife retaining cylinder 3. The head of the screw 13 is accessible from above so that the screw can be screwed down or up with a tool, whereby the tightening ruler 9 can be lowered or raised in the slot 6.

In order to ensure that the rulers 7, 9 and knife blade Z remain in the slot 6 until they are wedged up therein, resilient means 16 are provided to displace the rulers 7, 9 vertically relative to each other. These resilient means 16 (there are preferably a plurality thereof) are compressible by manually displacing the retaining ruler 7 upwards relative to the tightening ruler 9 until the total width of both rulers 7, 9 and the blade 2 is less than that of the slot 6. The rulers 7, 9 with the blade 2 are in this condition insertable into the slot 6, whereafter they are released. Thereby, the resilient means 16 will displace the retaining ruler 7 relative to the tightening ruler 9, which means that the total width of said rulers 7, 9 and the knife blade is increased to until they are fixed in the slot 6. The resilient means preferably consist of helical compression springs 16 which down below engage the retaining ruler 7 and on top engage the tightening ruler 9. These compression springs 16 are adapted, from a position in which they are compressed, to displace the retaining ruler 7 downwards relative to the tightening ruler 9. The compression springs 16 are preferably positioned in upwardly open holes 17 in the retaining ruler 7 and on top they engage the lower sides of tongues 18 protruding from the tightening ruler 9 and in over the retaining ruler 7. The mounting of the knife blade 2 in the knife retaining cylinder 3 is carried out by inserting the rulers 7, 9 and the blade 2 into the slot 6 as defined above. Thereby, the height adjustment means 13 of the tightening ruler 9 have been preset such that the blade 2 through the retaining ruler 7 will be in a position somewhat above its final cutting position. Thereafter, stop means 19 are screwed onto both end portions of the slot 6 by means of screws 20. These stop means 19 see to that the rulers 7, 9 can not accidentally fall out of the slot 6 during operation.

Thereafter, an adjusting step takes place during which the knife retaining cylinder 3 is rotated a so called setting turn relative to the counter pressure cylinder 5. Thereby, the edge of the blade 2 will strike the counter pressure cylinder 5, the peripheral surface which press the blade 2 downwards to its cutting position. During this down-stroke pressing the blade 2 will press the retaining ruler 7 downwards through the support portion 12, which means that the rulers 7, 9 and blade 2 automatically wedge up in the slot 6 with strength.

The retaining device 1 described above permits a very quick and safe mounting of knife blades 2 on the knife retaining cylinder 3 and it also ensures that the blade 2 is fixed in the exact correct position in the slot 6.

The rulers 7, 9 must of course be possible to loosen when required and this loosening may be carried out by means of a suitable withdrawal device 21 (see FIG. 5). Such a device may consist of a bracket 22 through which a screw 23 is threaded. The bracket 22 also has two pivotally mounted hook means 24 with hook portions 25 which from above are insertable into apertures 26 in the retaining ruler 7 to be hooked thereon. When the hook means 24 are hooked onto the retaining ruler 7, the screw 23 is screwed towards the tightening ruler 9 from above and thereby, the retaining ruler 7 is drawn upwards to the tightening ruler 9, which means that the keyed joint loosens and the blade 2 can be removed from the slot 6 for replacement or adjustment.

The invention is not limited to the embodiment described above and shown in the drawings, but may vary within the scope of the following claims. As an example of an alternative embodiment could be mentioned that the web can be of another material than paper, e.g. plastic; the resilient means may be of another type than helical compression springs. Finally, it can be mentioned that the height adjustment means are easily adjusted for adapting the height of the tightening ruler 9 in the slot 6. Hereby, the height adjustment means may e.g. be set such that the tightening ruler 9 is in position for mounting new dull knife blades. Additionally, the height adjustment means may be set such that the tightening ruler 9 is in a position higher up in the slot for mounting a sharpened or resharpened, i.e. somewhat lower knife blade.

We claim:

1. A device for retaining a knife blade for cutting, perforation or other treatment of a running web, preferably a paper web, whereby said web (4) runs between a rotatable knife retaining cylinder (3) and a rotatable counter pressure cylinder (5) and whereby the knife blade (2) and a retaining ruler (7) for retaining the blade (2) are provided in a slot (6) in the knife retaining cylinder (3), comprising: (a) a first wedge surface (10) downwardly inclined relative to the slot (6) and formed on the retaining ruler (7); (b) a tightening ruler disposed beside the retaining ruler in the slot (6); (c) a second corresponding downwardly inclined wedge surface (11) on the tightening ruler (9) disposed beside the retaining ruler in the slot (6) such that the first and second wedge surfaces are in contact whereby, during an adjustment maneuver in which the knife retaining cylinder (3) is rotated relative to the counter pressure cylinder (5), the knife blade is pressed downwards into the slot (6) by said counter pressure cylinder (5), whereby the blade (2), through a support portion (12) on the retaining ruler (7), displaces said retaining ruler (7) downwards relative to the tightening ruler (9) for wedging up said rulers (7, 9) and the blade (2) in the slot (6).

2. The device according to claim 1, further comprising resilient means (16) operatively disposed between the retaining ruler (7) and the tightening ruler (9) to displace the rulers (7,9) in a generally radial direction relative to each other after said rulers and the knife blade (2) have been disposed in the slot (6) and loosened, to ensure that the rulers (7, 9) and blade (2) remain in the slot (6) until they are wedged up therein.

3. The device according to claim 2, wherein the resilient means comprises helical compression springs (16), having a first portion engaging the retaining ruler (7) and a second portion engaging the tightening ruler (9) adapted, from a compressed position, to bias the rulers (7, 9) in generally radial direction in the slot (6) relative to each other.

4. The device according to claim 3, wherein the compression springs (16) are disposed in radially opening holes (17) in the retaining ruler (7) and engage a lower side of tongues (18) protruding from the tightening ruler (9) and over the retaining ruler (7).

5. The device according to claim 1, wherein the slot (6) has a bottom (14) and further comprising height adjustment means (13) for determining the height at which the tightening ruler (9) is set relative to the bottom (14) of the slot (6), the height adjustment means (13) having means enabling it to be set to alter a certain height position of the tightening ruler (9) relative to the bottom (14) of the slot (6) to another height position.

6. The device according to claim 5, wherein the height adjustment means (13) comprises screws which are screwed into the tightening ruler (9), protrude downwards therefrom like legs and are accessible from above for determining the height position of the tightening ruler (9).

7. The device according to claim 5, further comprising a protective strip (15) on the bottom (14) of the slot (16) formed of a material harder than that of the knife retaining cylinder (3) and adapted to engage the height adjustment means (13).

8. The device according to claim 1, wherein the support portion (12) of the retaining ruler (7) for the knife blade (2) comprises a flange protruding laterally from a lower portion of the retaining ruler (7), the width of which is less than the thickness of the blade (2).

9. The device according to claim 1, further comprising means enabling a withdrawal device (21) to be hooked onto the retaining ruler (7) for pulling up and loosening said ruler from the slot (6).

10. The device according to claim 1, further comprising stop means (19) located at end portions of the slot (6) to ensure that the rulers (7, 9) do not accidentally fall out of the slot (6).

* * * * *